US010424304B2

(12) United States Patent
Choo et al.

(10) Patent No.: US 10,424,304 B2
(45) Date of Patent: *Sep. 24, 2019

(54) ENERGY LOSSLESS-ENCODING METHOD AND APPARATUS, AUDIO ENCODING METHOD AND APPARATUS, ENERGY LOSSLESS-DECODING METHOD AND APPARATUS, AND AUDIO DECODING METHOD AND APPARATUS

(71) Applicant: SAMSUNG ELECTRONICS CO., LTD., Suwon-si (KR)

(72) Inventors: Ki-hyun Choo, Seoul (KR); Eun-mi Oh, Seoul (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

This patent is subject to a terminal disclaimer.

(21) Appl. No.: 14/687,008

(22) Filed: Apr. 15, 2015

(65) Prior Publication Data

US 2015/0221315 A1 Aug. 6, 2015

Related U.S. Application Data

(63) Continuation of application No. 13/657,151, filed on Oct. 22, 2012.

(Continued)

(51) Int. Cl.

*G10L 19/00* (2013.01)
*G10L 21/00* (2013.01)

(Continued)

(52) U.S. Cl.

CPC ..... *G10L 19/0017* (2013.01); *G10L 19/032* (2013.01); *G10L 21/00* (2013.01); *G10L 19/0204* (2013.01); *G10L 19/035* (2013.01)

(58) Field of Classification Search

CPC ..... G10L 19/00; G10L 19/032; G10L 19/035

(Continued)

(56) References Cited

U.S. PATENT DOCUMENTS 5,884,269 A * 3/1999 Cellier ..... G10L 19/04 341/64
6,064,954 A * 5/2000 Cohen ..... G10L 19/0212 704/206

(Continued)

FOREIGN PATENT DOCUMENTS

CN 1331826 A 1/2002
CN 101290771 A 10/2008

(Continued)

OTHER PUBLICATIONS

Communication dated May 15, 2015 issued by the Mexican Patent Office in counterpart Mexican Patent Application No. MX/a/2014/004797.

(Continued)

*Primary Examiner* — Feng-Tzer Tzeng
(74) *Attorney, Agent, or Firm* — Sughrue Mion, PLLC

(57) ABSTRACT

A lossless encoding method is provided that includes determining a lossless encoding mode of a quantization coefficient as one of an infinite-range lossless encoding mode and a finite-range lossless encoding mode; encoding the quantization coefficient in the infinite-range lossless encoding mode in correspondence with a result of the lossless encoding mode determination; and encoding the quantization coefficient in the finite-range lossless encoding mode in correspondence with a result of the lossless encoding mode determination.

7 Claims, 10 Drawing Sheets

Related U.S. Application Data

(60) Provisional application No. 61/549,942, filed on Oct. 21, 2011.

(51) Int. Cl.
*G10L 19/032* (2013.01)
*G10L 19/035* (2013.01)
*G10L 19/02* (2013.01)

(58) Field of Classification Search
USPC ..... 704/230, 500, E19.001
See application file for complete search history.

(56) References Cited

U.S. PATENT DOCUMENTS

| | | | | |
|---|---|---|---|---|
| 6,466,912 | B1 * | 10/2002 | Johnston | G10L 19/0204 704/226 |
| 6,611,212 | B1 | 8/2003 | Craven et al. | |
| 7,191,121 | B2 * | 3/2007 | Liljeryd | G10L 19/0208 704/200 |
| 7,496,505 | B2 | 2/2009 | Manjunath et al. | |
| 7,791,510 | B2 | 9/2010 | Maeda | |
| 7,965,206 | B2 | 6/2011 | Choo et al. | |
| 8,315,880 | B2 * | 11/2012 | Kovesi | G10L 19/032 704/229 |
| 8,515,767 | B2 | 8/2013 | Reznik | |
| 8,576,096 | B2 | 11/2013 | Mittal et al. | |
| 9,361,895 | B2 * | 6/2016 | Porov | G10L 19/0017 |
| 9,589,569 | B2 * | 3/2017 | Porov | G10L 19/0017 |
| 9,858,934 | B2 * | 1/2018 | Porov | G10L 19/0017 |
| 2002/0016161 | A1 * | 2/2002 | Dellien | G10L 19/00 455/403 |
| 2004/0070523 | A1 | 4/2004 | Craven et al. | |
| 2007/0016411 | A1 * | 1/2007 | Kim | G10L 19/02 704/226 |
| 2008/0077413 | A1 | 3/2008 | Eguchi | |
| 2008/0112632 | A1 * | 5/2008 | Vos | G10L 19/0017 382/248 |
| 2009/0030678 | A1 * | 1/2009 | Kovesi | G10L 19/032 704/230 |
| 2009/0100121 | A1 * | 4/2009 | Mittal | G10L 19/035 708/495 |
| 2010/0063810 | A1 * | 3/2010 | Gao | G10L 19/032 704/230 |
| 2011/0106545 | A1 | 5/2011 | Disch et al. | |
| 2011/0320196 | A1 | 12/2011 | Choo et al. | |
| 2013/0339038 | A1 * | 12/2013 | Norvell | G10L 19/032 704/500 |
| 2014/0156284 | A1 * | 6/2014 | Porov | G10L 19/0017 704/500 |
| 2016/0210977 | A1 * | 7/2016 | Ghido | G10L 19/038 |
| 2016/0307576 | A1 * | 10/2016 | Fuchs | G10L 19/0017 |
| 2017/0178637 | A1 * | 6/2017 | Porov | G10L 19/0017 |

FOREIGN PATENT DOCUMENTS

| | | | |
|---|---|---|---|
| CN | 101390158 | A | 3/2009 |
| CN | 101420231 | A | 4/2009 |
| EP | 1989707 | A2 | 11/2008 |
| JP | 200883295 | A | 4/2008 |
| JP | 2008107615 | A | 5/2008 |
| JP | 2009527785 | A | 7/2009 |
| JP | 2011-503653 | A | 1/2011 |
| JP | 2011501511 | A | 1/2011 |
| KR | 10-2005-0112796 | A | 12/2005 |
| KR | 1020080107428 | A | 12/2008 |
| KR | 10-0889750 | B1 | 3/2009 |
| KR | 10-2010-0035955 | A | 4/2010 |
| KR | 10-2011-0060181 | A | 6/2011 |
| KR | 10-2011-0071231 | A | 6/2011 |
| TW | I226041 | B | 1/2005 |
| WO | 2007096551 | A2 | 8/2007 |

OTHER PUBLICATIONS

Communication dated Mar. 31, 2015 issued by the European Patent Office in counterpart European Patent Application No. 12842197.1.

International Search Report (PCT/ISA/210) dated Mar. 27, 2013, issued in International Application No. PCT/KR2012/008688.

Written Opinion (PCT/ISA/237) dated Mar. 27, 2013, issued in International Application No. PCT/KR2012/008688.

Communication dated Sep. 1, 2015, issued by the Japanese Intellectual Property Office in counterpart Japanese Application No. 2014-537001.

Communication dated Oct. 30, 2015, issued by the State Intellectual Property Office of P.R. China in counterpart Chinese Application No. 201280063986.6.

Communication dated Apr. 21, 2016, issued by the Taiwanese Intellectual Property Office in counterpart Taiwanese Application No. 101138943.

Communication dated Jun. 21, 2016, issued by the Japanese Intellectual Property Office in counterpart Japanese Application No. 2014-537001.

Communication dated Sep. 23, 2016 issued by the State Intellectual Property Office of P.R. China in counterpart Chinese Patent Application No. 201280063986.6.

Communication dated Apr. 3, 2018, issued by the Japanese Patent Office in counterpart Japanese Application No. 2017-019014.

Communication dated Apr. 2, 2019, issued by the Korean Patent Office in counterpart Korean Application No. 10-2012-0117509 English translation.

Quackenbush and Johnston, "Noiseless coding of quantized spectral components in MPEG-2 Advanced Audio Coding", 1997, IEEE 1997 Workshop on Applications of Signal Processing to Audio and Acoustics, 4 pages total.

* cited by examiner

ENERGY LOSSLESS-ENCODING METHOD AND APPARATUS, AUDIO ENCODING METHOD AND APPARATUS, ENERGY LOSSLESS-DECODING METHOD AND APPARATUS, AND AUDIO DECODING METHOD AND APPARATUS

CROSS-REFERENCE TO RELATED PATENT APPLICATION

This application is a continuation of U.S. application Ser. No. 13/657,151 filed on Oct. 22, 2012, which claims the benefit of U.S. Provisional Application No. 61/549,942 filed on Oct. 21, 2011 in the U.S. Patent Trademark Office, the disclosures of which are incorporated by reference herein in their entirety.

BACKGROUND

1. Field

The present disclosure relates to audio encoding and decoding, and more particularly, to an energy lossless encoding method and apparatus, whereby the number of bits required to encode an actual spectral component may be increased by reducing the number of bits required to encode energy information of an audio spectrum within a limited bit range without an increase in complexity or deterioration in quality of reconstructed audio, an audio encoding method and apparatus, an energy lossless decoding method and apparatus, an audio decoding method and apparatus, and a multimedia device employing the same.

2. Description of the Related Art

When an audio signal is encoded, side information, such as energy, in addition to an actual spectral component may be included in a bitstream. In this case, by reducing the number of bits allocated to encode the side information with minimum loss, the number of bits allocated to encode the actual spectral component may be increased.

That is, when an audio signal is encoded or decoded, it is required to restore an audio signal having the best audio quality in a corresponding bit range by efficiently using a limited number of bits at a particularly low bit rate.

SUMMARY

It is an aspect to provide an energy lossless encoding method, whereby the number of bits required to encode an actual spectral component may be increased while reducing the number of bits required to encode energy information of an audio spectrum within a limited bit range without an increase in complexity or deterioration in quality of restored audio, an audio encoding method, an energy lossless decoding method, and an audio decoding method.

It is another aspect to provide an energy lossless encoding apparatus, whereby the number of bits required to encode an actual spectral component may be increased by reducing the number of bits required to encode energy information of an audio spectrum within a limited bit range without an increase in complexity or deterioration in quality of restored audio, an audio encoding apparatus, an energy lossless decoding apparatus, and an audio decoding apparatus.

It is another aspect to provide a computer-readable recording medium storing a computer-readable program for executing the energy lossless encoding method, the audio encoding method, the energy lossless decoding method, or the audio decoding method.

It is another aspect to provide a multimedia device employing the energy lossless encoding apparatus, the audio encoding apparatus, the energy lossless decoding apparatus, or the audio decoding apparatus.

According to an aspect of one or more exemplary embodiments, there is provided a lossless encoding method comprising: determining a lossless encoding mode of quantization coefficients as one of an infinite-range lossless encoding mode and a finite-range lossless encoding mode; encoding the quantization coefficients in the infinite-range lossless encoding mode in correspondence with a result of the lossless encoding mode determination; and encoding the quantization coefficients in the finite-range lossless encoding mode in correspondence with a result of the lossless encoding mode determination.

According to another aspect of one or more exemplary embodiments, there is provided an audio encoding method comprising: quantizing energy obtained in units of frequency bands from spectral coefficients that are generated from an audio signal in a time domain; lossless-encoding energy quantization coefficients by using one of an infinite-range lossless encoding mode and a finite-range lossless encoding mode in consideration of the number of bits representing the energy quantization coefficients and the numbers of bits generated as a result of encoding the energy quantization coefficients in the infinite-range lossless encoding mode and the finite-range lossless encoding mode; allocating bits to be used for encoding in units of frequency bands by using the energy quantization coefficients; and quantizing and lossless-encoding the spectral coefficients based on the allocated bits.

According to another aspect of one or more exemplary embodiments, there is provided a lossless decoding method comprising: determining a lossless encoding mode of quantization coefficients included in a bitstream; decoding the quantization coefficients in an infinite-range lossless decoding mode in correspondence with a result of the lossless encoding mode determination; and decoding the quantization coefficients in a finite-range lossless decoding mode in correspondence with a result of the lossless encoding mode determination.

According to another aspect of one or more exemplary embodiments, there is provided a lossless decoding method comprising: determining a lossless encoding mode of energy quantization coefficients included in a bitstream and decoding the energy quantization coefficients in an infinite-range lossless decoding mode or a finite-range lossless decoding mode in correspondence with a result of the lossless encoding mode determination; dequantizing the lossless-decoded energy quantization coefficients and allocating bits to be used for encoding in units of frequency bands by using the energy dequantization coefficients; lossless-decoding spectral coefficients obtained from the bitstream; and dequantizing the lossless-decoded spectral coefficients based on the allocated bits.

BRIEF DESCRIPTION OF THE DRAWINGS

The above and other aspects will become more apparent by describing in detail exemplary embodiments thereof with reference to the attached drawings in which.

DETAILED DESCRIPTION

Figure 1:
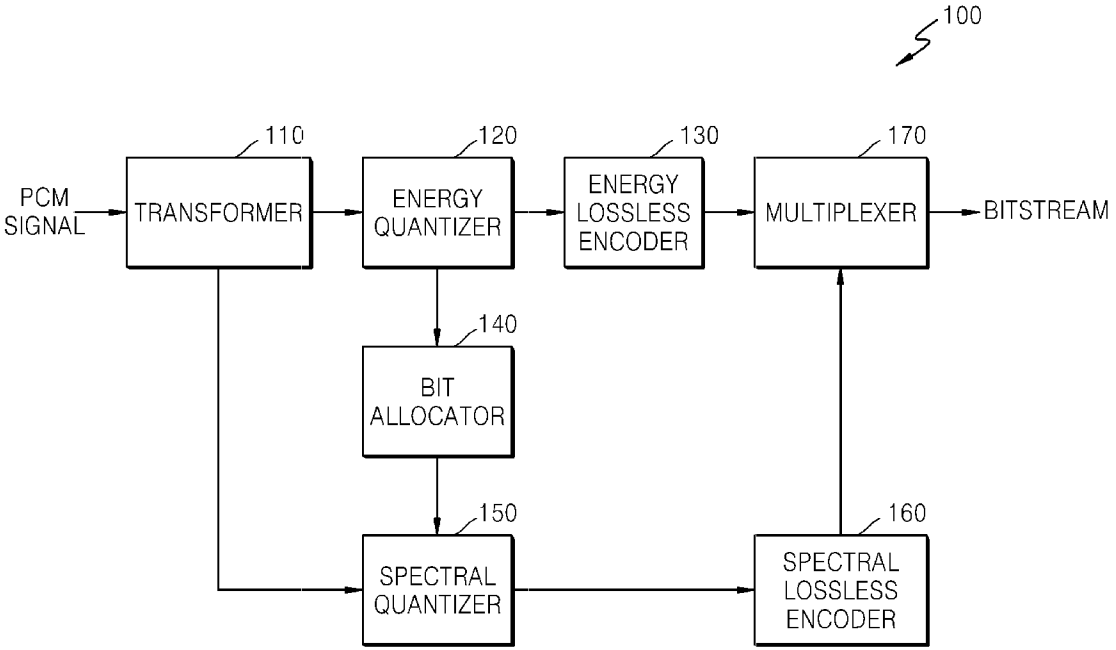
FIG. 1 is a block diagram of an audio encoding apparatus according to an exemplary embodiment.

The present inventive concept may allow various kinds of change or modification and various changes in form, and specific exemplary embodiments will be illustrated in drawings and described in detail in the specification. However, it should be understood that the specific exemplary embodiments do not limit the present inventive concept to a specific form but include every modified, equivalent, or replaced form within the spirit and technical scope of the present inventive concept. In the following description, well-known functions or constructions are not described in detail since they would obscure the inventive concept with unnecessary detail.

Although terms, such as 'first' and 'second', can be used to describe various elements, the elements cannot be limited by the terms. The terms can be used to distinguish a certain element from another element.

The terminology used in the application is used only to describe specific exemplary embodiments and does not have any intention to limit the inventive concept. Although general terms as currently widely used as possible are selected as the terms used in the present inventive concept while taking functions in the present inventive concept into account, they may vary according to an intention of those of ordinary skill in the art, judicial precedents, or the appearance of new technology. In addition, in specific cases, terms intentionally selected by the applicant may be used, and in this case, the meaning of the terms will be disclosed in corresponding description of the inventive concept. Accordingly, the terms used in the present disclosure should be defined not by simple names of the terms but by the meaning of the terms and the content over the present inventive concept.

An expression in the singular includes an expression in the plural unless they are clearly different from each other in context. In the application, it should be understood that terms, such as 'include' and 'have', are used to indicate the existence of implemented feature, number, step, operation, element, part, or a combination of them without excluding in advance the possibility of existence or addition of one or more other features, numbers, steps, operations, elements, parts, or combinations of them.

The present inventive concept will now be described more fully with reference to the accompanying drawings, in which exemplary embodiments are shown. Like reference numerals in the drawings denote like elements, and thus their repetitive description will be omitted.

FIG. 1 is a block diagram of an audio encoding apparatus according to an exemplary embodiment.

The audio encoding apparatus 100 shown in FIG. 1 may include a transformer 110, an energy quantizer 120, an energy lossless encoder 130, a bit allocator 140, a spectral quantizer 150, a spectral lossless encoder 160, and a multiplexer 170. The multiplexer 170 may be optionally included and be replaced by another component for performing a bit packing function. Alternatively, lossless-encoded energy data and lossless-encoded spectral data may form separate bitstreams to be stored or transmitted. After or before a spectral quantization process, a normalizer for performing normalization using an energy value may be further included. The components may be integrated in at least one module and be implemented by at least one processor (not shown). An audio signal may indicate a media signal, such as sound, indicating music, speech, or a mixed signal of music and speech. However, hereinafter, an audio signal is used for convenience of description. An audio signal in a time domain, which is input to the audio encoding apparatus 100, may have various sampling rates, and a band configuration of energy to be used to quantize a spectrum may vary based on a sampling rate. Accordingly, the number of quantized energies for which lossless encoding is performed may vary. The sampling rates are, for example, 8 KHz, 16 KHz, 32 KHz, 48 KHz, and so forth, but are not limited thereto. The audio signal in the time domain for which a sampling rate and a target bit rate are determined may be provided to the transformer 110.

Referring to FIG. 1, the transformer 110 may generate an audio spectrum by transforming the audio signal in the time domain, for example, a pulse code modulation (PCM) signal, into an audio spectrum in a frequency domain. The time/frequency domain transform may be performed by using various well-known methods, such as a modified discrete cosine transform (MDCT). Transform coefficients, e.g., MDCT coefficients, obtained by the transformer 110 may be provided to the energy quantizer 120 and the spectral quantizer 150.

The energy quantizer 120 may acquire an energy value in units of frequency bands from the transform coefficients provided from the transformer 110. A frequency band is a unit of grouping samples of the audio spectrum and may have a uniform or non-uniform length by reflecting a critical band. In a non-uniform case, the frequency bands may be set so that the number of samples included in each frequency band gradually increases from a start sample to a last sample for one frame. When multiple bit rates are supported, the frequency bands may be set so that the number of samples included in each frequency band is the same for different bit rates. The number of frequency bands included in one frame or the number of samples included in each frequency band may be defined in advance. The energy value may indicate an envelope of transform coefficients included in each frequency band, which may indicate an average amplitude, an average energy, a power value, or a norm value. The frequency band may indicate a parameter band or a scale factor band.

Energy E(k) of a kth frequency band may be acquired by, for example, Equation 1.

$$E(k) = \log 2\left(\sum_{l=start}^{end} S(l) * S(l)\right) \tag{1}$$

In Equation 1, S(l) denotes a frequency spectrum, and 'start' and 'end' denote a start sample and a last sample of a current frequency band, respectively.

The energy quantizer 120 may generate an energy quantization coefficient by quantizing the acquired energy using a quantization step size. In detail, the energy quantization coefficient may be obtained by dividing the energy E(k) of the kth frequency band by the quantization step size and rounding up the division result to an integer. In this case, the energy quantizer 120 may perform the quantization so that the energy quantization coefficient has an infinite range without a quantization boundary of energy. The energy quantization coefficient may be represented as an energy quantization index. For example, if it is assumed that an original energy value is 20.2 and the quantization step size is 2, a quantized value is 20, and the energy quantization coefficient and the energy quantization index may be represented as 10. According to an exemplary embodiment, for a current frequency band, a difference between an energy quantization coefficient of the current frequency band and an energy quantization coefficient of a previous frequency band, i.e., a quantization delta value, may be lossless-encoded. In this case, when infinite-range lossless encoding is applied, the energy quantization coefficient or the difference value, i.e., the quantization delta value, may be used as an input of the infinite-range lossless encoding. When finite-range lossless encoding is applied, the quantization delta value of the energy quantization coefficient is used as an input of the finite-range lossless encoding, wherein the energy quantization coefficient is lossless-encoded by using a value obtained by adding a specific value to the input value. In this case, since a previous frequency band of a first frequency band does not exist, the quantization delta value is not applied to a value for the first frequency band, and an input signal of the finite-range lossless encoding may be generated by subtracting another value from the value for the first frequency band instead of the addition of the specific value.

The energy lossless encoder 130 may lossless-encode the energy quantization coefficient provided from the energy quantizer 120. According to an exemplary embodiment, one of a first lossless encoding mode and a second lossless encoding mode for an energy quantization coefficient of an infinite range may be selected on a frame basis. In the first lossless encoding mode, an algorithm of lossless-encoding an energy quantization coefficient of an infinite range may be used, and in the second lossless encoding mode, an algorithm of lossless-encoding an energy quantization coefficient of a finite range may be used. According to another exemplary embodiment, a quantization delta value between frequency bands may be obtained for the energy quantization coefficient of each frequency band, which is provided from the energy quantizer 120, and the quantization delta value may be lossless-encoded. Energy data obtained as a result of the lossless-encoding may be included in a bitstream together with information indicating the first or second lossless encoding mode and be stored or transmitted.

The bit allocator 140 may acquire an energy dequantization coefficient by dequantizing the energy quantization coefficient provided from the energy quantizer 120. The bit allocator 140 may calculate a masking threshold using the energy dequantization coefficient on a frequency band basis for the total number of bits corresponding to the target bit rate and determine the allocated number of bits required for perceptual coding of each frequency band in integer or fraction point units using the masking threshold. In detail, the bit allocator 140 may allocate bits by estimating the allowable number of bits using the energy dequantization coefficient obtained on a frequency band basis and restrict the allocated number of bits not to exceed the allowable number of bits. In this case, the number of bits may be sequentially allocated from a frequency band having a higher energy value. In addition, by weighting an energy value of each frequency band according to perceptual importance of each frequency band, an adjustment may be made such that a more number of bits are allocated to a perceptually more important frequency band. The perceptual importance may be determined through psychoacoustic weighting as in ITU-T G.719.

The spectral quantizer 150 may quantize the transform coefficients provided from the transformer 110 by using the allocated number of bits that is determined on a frequency band basis and generate spectral quantization coefficients on a frequency band basis.

The spectral lossless encoder 160 may lossless-encode the spectral quantization coefficients provided from the spectral quantizer 150. As an example of lossless encoding algorithms, factorial pulse coding (FPC) may be used. According to FPC, information, such as a pulse position, a pulse magnitude, and a pulse sign etc., may be represented in a factorial format within the allocated number of bits. FPC data obtained as a result of FPC may be included in a bitstream and be stored or transmitted.

The multiplexer 170 may generate a bitstream from the energy data provided from the energy lossless encoder 130 and the spectral data provided from the spectral lossless encoder 160.

Figure 2:
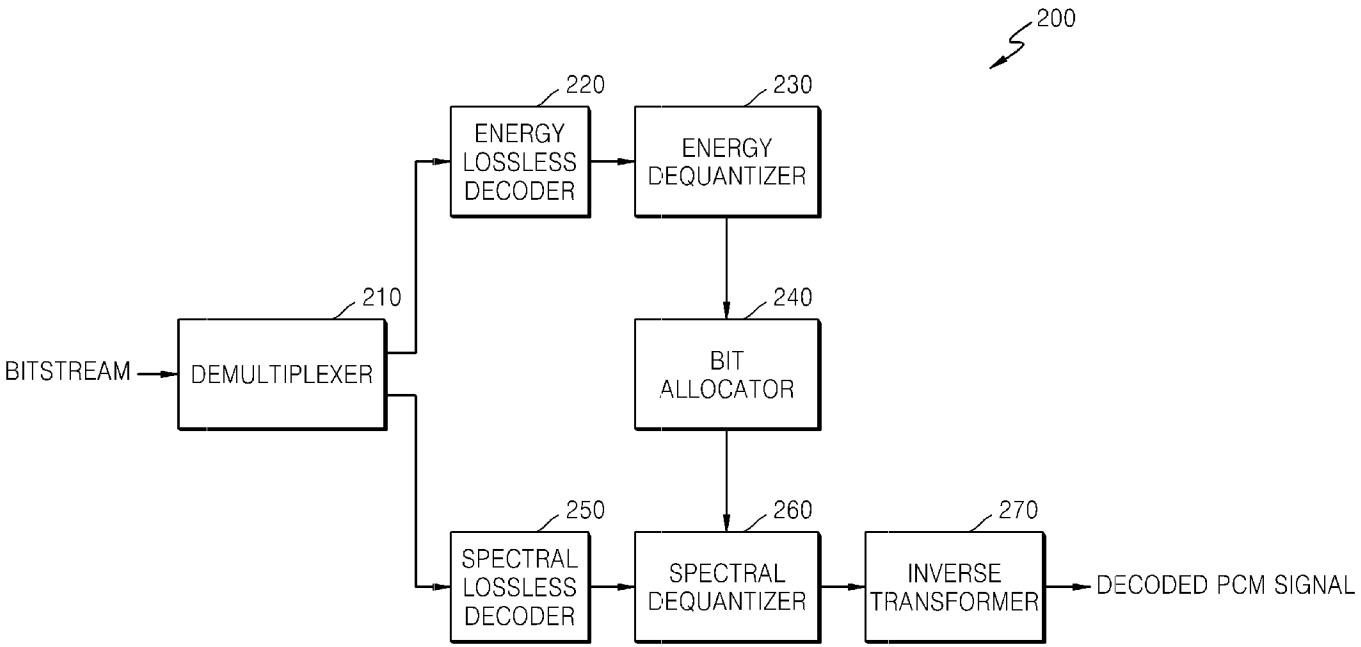
FIG. 2 is a block diagram of an audio decoding apparatus according to an exemplary embodiment.

FIG. 2 is a block diagram of an audio decoding apparatus according to an exemplary embodiment.

The audio decoding apparatus 200 shown in FIG. 2 may include a demultiplexer 210, an energy lossless decoder 220, an energy dequantizer 230, a bit allocator 240, a spectral lossless decoder 250, a spectral dequantizer 260, and an inverse transformer 270. The components may be integrated in at least one module and be implemented by at least one processor (not shown). As in the audio encoding apparatus 100, the demultiplexer 210 may be optionally included and be replaced by another component for performing a bit unpacking function. After or before a spectral dequantization process, a denormalizer (not shown) for performing denormalization using an energy value may be further included.

Referring to FIG. 2, the demultiplexer 210 may parse a bitstream and respectively provide encoded energy data and encoded spectral data to the energy lossless decoder 220 and the spectral lossless decoder 250.

The energy lossless decoder 220 may generate energy quantization coefficients by lossless-decoding the encoded energy data.

The energy dequantizer 230 may generate energy dequantization coefficients by dequantizing the energy quantization coefficients provided from the energy lossless decoder 220, using a quantization step size. In detail, the energy dequantizer 230 may obtain the energy dequantization coefficients by multiplying the energy quantization coefficients by the quantization step size.

The bit allocator 240 may allocate bits in integer or fraction point units on a frequency band basis using the energy dequantization coefficients provided from the energy dequantizer 230. In detail, bits per sample are sequentially allocated from a frequency band having a higher energy value. That is, bits per sample are first allocated to a frequency band having the highest energy value, and priority is changed by decreasing an energy value of a corresponding frequency band to allocate bits to other frequency bands. This process is repeated until all of the bits available in a given frame are allocated. An operation of the bit allocator 240 is substantially the same as that of the bit allocator 140 of the audio encoding apparatus 100.

The spectral lossless decoder 250 may generate spectral quantization coefficients by lossless-decoding the encoded spectral data.

The spectral dequantizer 260 may generate spectral dequantization coefficients by dequantizing the spectral quantization coefficients provided from the spectral lossless decoder 250, using the allocated number of bits that is determined on a frequency band basis.

The inverse transformer 270 may reconstruct an audio signal in the time domain by inversely transforming the spectral dequantization coefficients provided from the spectral dequantizer 260.

Figure 3:
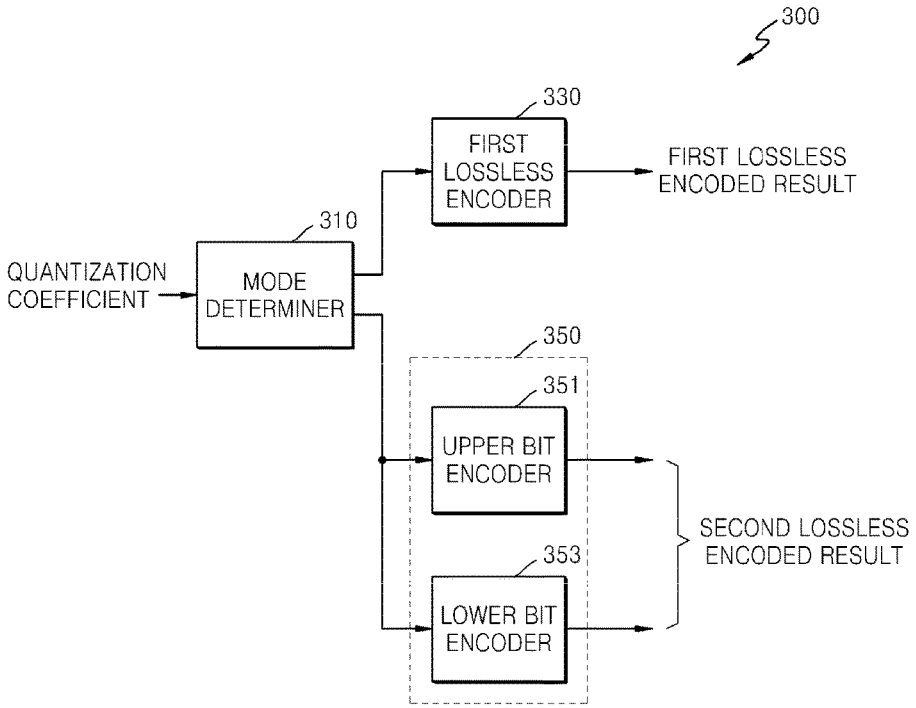
FIG. 3 is a block diagram of an energy lossless encoding apparatus according to an exemplary embodiment.

FIG. 3 is a block diagram of an energy lossless encoding apparatus according to an exemplary embodiment.

The energy lossless encoding apparatus 300 shown in FIG. 3 may include a mode determiner 310, a first lossless encoder 330, and a second lossless encoder 350. The second lossless encoder 350 may include an upper bit encoder 351 and a lower bit encoder 353. The components may be integrated in at least one module and be implemented by at least one processor (not shown).

Referring to FIG. 3, the mode determiner 310 may determine an encoding mode for energy quantization coefficients as one of the first lossless encoding mode and the second lossless encoding mode. When the first lossless encoding mode is determined to be the encoding mode, the energy quantization coefficients may be provided to the first lossless encoder 330. Otherwise, when the second lossless encoding mode is determined to be the encoding mode, the energy quantization coefficients may be provided to the second lossless encoder 350. The mode determiner 310 may determine whether the energy quantization coefficients can be represented as a specific number of bits, e.g., N bits (N is a natural number equal to or greater than 2) for all frequency bands in one frame. If the energy quantization coefficients cannot be represented as the specific number of bits for at least one frequency band, the mode determiner 310 may determine the encoding mode for the energy quantization coefficients as the first lossless encoding mode in which an infinite-range lossless encoding algorithm is used. Otherwise, if the energy quantization coefficients can be represented as the specific number of bits for all frequency bands, the mode determiner 310 may determine the encoding mode for the energy quantization coefficients as one of the first lossless encoding mode in which an infinite-range lossless encoding algorithm is used and the second lossless encoding mode in which a finite-range lossless encoding algorithm is used. In detail, the mode determiner 310 may encode an upper bit energy quantization coefficient in a plurality of modes of the second lossless encoding mode for all frequency bands in a current frame, compare a least number of bits used as a result of the encoding with bits used as a result of encoding in the first lossless encoding mode, and determine one of the first lossless encoding mode and the second lossless encoding mode as a result of the comparison. In response to a result of the mode determination, first additional information D0 of 1 bit indicating the encoding mode of the energy quantization coefficients may be generated and included in a bitstream. When the encoding mode is determined as the second lossless encoding mode, the mode determiner 310 may divide the energy quantization coefficient of N bits into N0 upper bits and N1 lower bits and provide the N0 upper bits and the N1 lower bits to the second lossless encoder 350. In this case, N0 may be represented as N−N1, and N1 may be represented as N−N0. According to an exemplary embodiment, N, N0, and N1 may be set to 6, 5, and 1, respectively.

The first lossless encoder 330 may perform FPC of the energy quantization coefficients. When delta coding is applied, FPC may divide each of difference values between energy quantization coefficients of frequency bands into a sign and an absolute value, transmit the sign if the absolute value is not 0, and transmit the absolute value by representing the absolute value as stacked pulses, i.e., how many pulses are stacked on a frequency band basis.

The second lossless encoder 350 may divide the energy quantization coefficient into upper bits and lower bits and lossless-encode the energy quantization coefficient by applying a Huffman encoding method or a bit packing method to the upper bits and applying the bit packing method to the lower bits.

In detail, the upper bit encoder 351 may prepare $2^{N0}$ symbols for upper bit data represented as N0 bits and encode the $2^{N0}$ symbols in a method in which a less number of bits are required from among the Huffman encoding method and the bit packing method. The upper bit encoder 351 may have M encoding modes, in detail, (M−1) Huffman encoding modes and 1 bit packing mode. For example, when M is 4, second additional information D1 of 2 bits indicating an encoding mode of the upper bits may be generated and be included in a bitstream together with the first additional information D0.

The lower bit encoder 353 may encode lower-bit data represented as N1 bits by applying the bit packing method. When one frame includes $N_b$ frequency bands, the lower-bit data may be encoded using $N1 \times N_b$ bits as a total number of bits.

Figure 4:
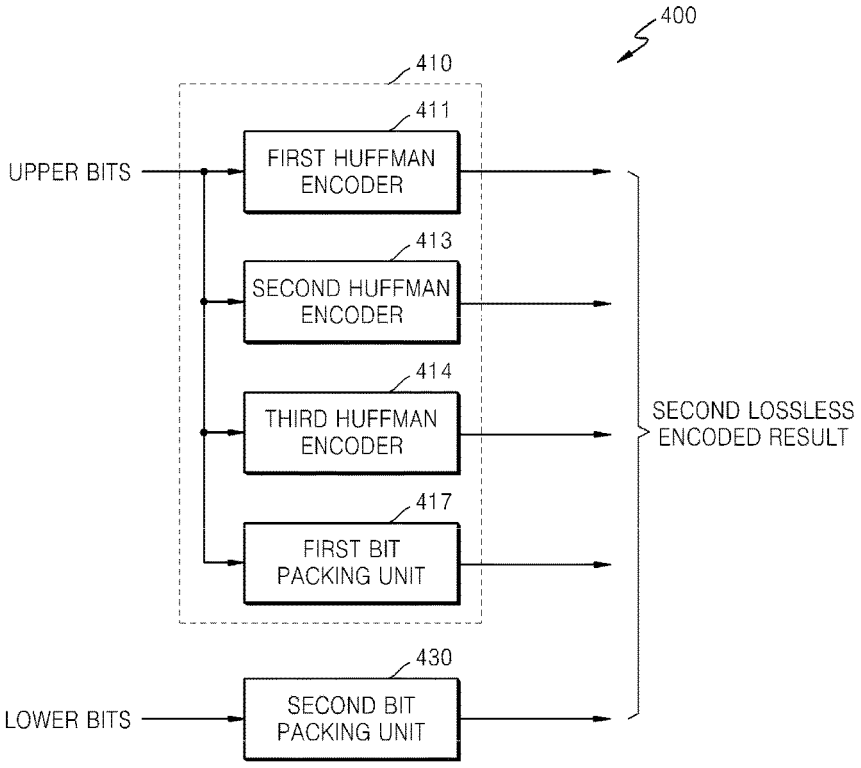
FIG. 4 is a block diagram of a second lossless encoder of the energy lossless encoding apparatus of FIG. 3, according to an exemplary embodiment.

FIG. 4 is a detailed block diagram of the second lossless encoder of FIG. 3, according to an exemplary embodiment.

The second lossless encoder 400 shown in FIG. 4 may include an upper bit encoder 410 and a second bit packing unit 430. The upper bit encoder 410 may include a plurality of Huffman encoders, e.g., first to third Huffman encoders 411, 413, and 415, and a first bit packing unit 417. Although the first to third Huffman encoders 411, 413, and 415 are included according to various Huffman encoding methods, the plurality of Huffman encoders are not limited thereto and may be changed in the design by considering the allowable number of bits for encoding.

Referring to FIG. 4, when delta coding is used for all frequency bands existing in one frame, the second lossless encoder 400 may operate only if a difference value between energy quantization coefficients of a current frequency band and a previous frequency band is represented as a specific number of bits, e.g., 6 bits. For example, when an energy quantization coefficient difference value of a first frequency band does not belong to 64 kinds that can be represented by 6 bits, lossless encoding may be performed by the first lossless encoder 330.

The upper bit encoder 410 may apply a Huffman encoding mode in which a least number of bits are used, which has been already determined by the mode determiner 310, to upper bit encoding for all frequency bands from among the first to third Huffman encoders 411, 413, and 415 and the first bit packing unit 417 as it is. In this case, the same lossless encoding mode may be applied to all frequency bands in one frame, and accordingly, for example, the same bit value in relation to a lossless encoding mode of energy may be included in a header of each frame.

The first to third Huffman encoders 411, 413, and 415 may perform Huffman encoding by or without using a context. For example, the first Huffman encoder 411 may be implemented to perform Huffman encoding without using a context. The second Huffman encoder 413 may be implemented to perform Huffman encoding by using a context. When a context is used, according to an exemplary embodiment, a quantization delta value for a previous frequency band may be used as the context to perform Huffman encoding of a quantization delta value for a current frequency band. According to another exemplary embodiment, upper bits, e.g., a value represented by 5 bits of the quantization delta value for the previous frequency band may be used as the context. The third Huffman encoder 415 may not use a context but construct a Huffman table with a less number of symbols, as compared with the first Huffman encoder 411. The first bit packing unit 417 may encode upper bit data as it is and output, for example, 5-bit data.

The upper bit encoder 410 may further include a comparator (not shown) regardless of an encoding mode of upper bits, which has been determined in the determination of the first or second lossless encoding mode, to compare encoded results of the first to third Huffman encoders 411, 413, and 415 and the first bit packing unit 417 with one another for the upper bit data and select and output an encoding mode requiring a least number of bits. The second lossless encoding mode may be applied to all frequency bands in one frame, and different Huffman encoding modes may be simultaneously applied to upper bit encoding.

Figure 5:
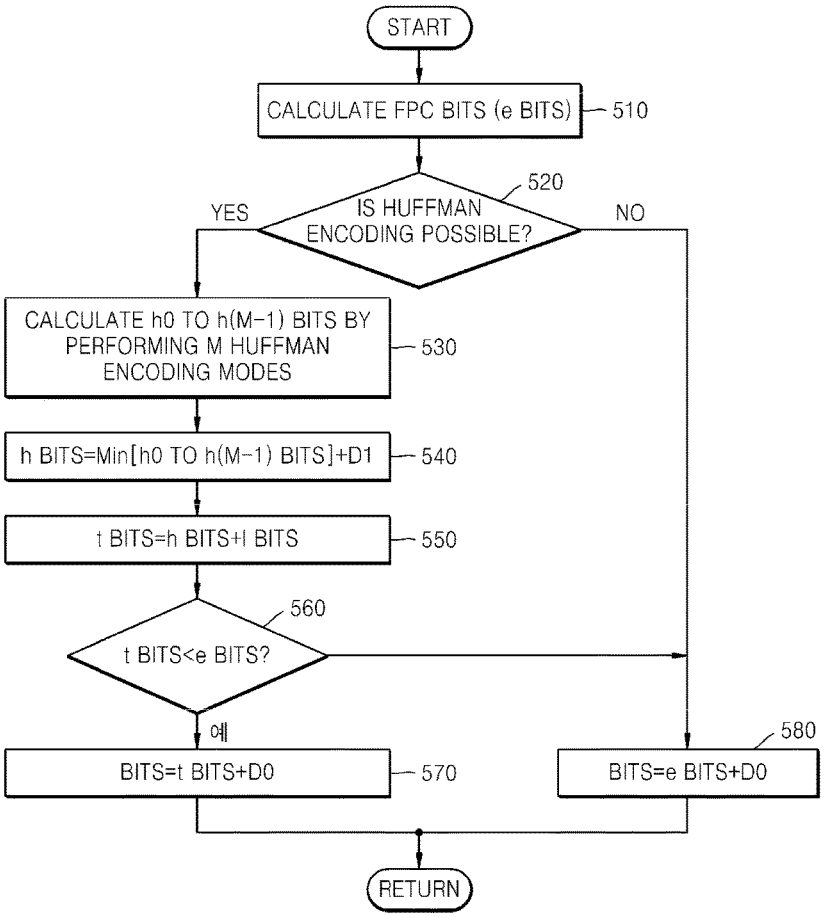
FIG. 5 is a flowchart illustrating an energy lossless encoding method according to an exemplary embodiment.

FIG. 5 is a flowchart illustrating an energy lossless encoding method according to an exemplary embodiment, wherein the energy lossless encoding method may be performed by at least one processing device. In addition, the energy lossless encoding method of FIG. 5 may be performed on a frame basis. For convenience of description, it is assumed that M=4, i.e., the number of Huffman encoding modes for upper bit data is 4. In addition, it is assumed that the 4 Huffman encoding modes are obtained by the first to third Huffman encoders 411, 413, and 415 and the first bit packing unit 417.

Referring to FIG. 5, in operation 510, FPC, which is an infinite-range lossless encoding algorithm, may be performed for an input energy quantization coefficient, and bits used in FPC, i.e., e bits, are calculated. Operation 510 may be performed before operation 580.

In operation 520, a difference value between energy quantization coefficients, which is input for energy lossless encoding, may be checked to select one of the first and second lossless encoding modes. That is, when each of difference values between energy quantization coefficients is represented by a specific number of bits, in all frequency bands in one frame, the Huffman encoding corresponding to the second lossless encoding mode may be selected. However, when difference values between energy quantization coefficients is not represented by the specific number of bits, in at least one frequency band in one frame, FPC corresponding to the first lossless encoding mode may be selected. That is, if it is determined that the Huffman encoding cannot be performed, in operation 580, a first lossless encoded result may be generated by adding 1 bit corresponding to first additional information D0 indicating a lossless encoding mode of energy quantization coefficients to the e bits used in FPC for a corresponding frame.

Otherwise, if it is determined that the Huffman encoding can be performed, in operation 530, upper bit data may be encoded in M Huffman encoding modes, and bits used in the M Huffman encoding modes, i.e., h0 to h(M−1) bits, may be calculated. The h0 bits are bits used when a first Huffman encoding mode is applied, and the h(M−1) bits are bits used when an Mth Huffman encoding mode is applied.

In operation 540, a Huffman encoding mode in which a least number of bits are used may be selected by comparing the h0 to h(M−1) bits with one another, and lossless encoded bits, i.e., h bits, for upper bits may be calculated by adding 2 bits representing second additional information D1 indicating the selected encoding mode.

In operation 550, total bits used in the Huffman encoding, i.e., t bits, may be calculated by adding bits used in lossless encoding of lower bits, i.e., l bits, to the bits used in lossless encoding of the upper bits, i.e., h bits. If the number of lower bits is 1, and the number of frequency bands in one frame is 20, the number of l bits is 20.

In operation 560, the t bits used in the Huffman encoding of the total bits, which are calculated in operation 550, may be compared with the e bits used in FPC, which is calculated in operation 510. That is, if the number of t bits used in the Huffman encoding is less than the number of e bits used in FPC, it may be determined that the second lossless encoding, i.e., the Huffman encoding, is performed for the upper bits.

If it is determined in operation 560 that the second lossless encoding, i.e., the Huffman encoding, is performed for the upper bits, in operation 570, a second lossless encoded result may be generated by adding 1 bit corresponding to the first additional information D0 indicating a lossless encoding mode of energy quantization coefficients to the t bits used in the Huffman encoding.

In operation 580, a first lossless encoded result may be generated by adding 1 bit corresponding to the first additional information D0 indicating a lossless encoding mode of energy quantization coefficients to the e bits used in FPC if it is determined in operation 520 that the Huffman encoding cannot be performed for the energy quantization coefficients or determined in operation 560 that the first lossless encoding, i.e., FPC, is performed for the upper bits.

In conclusion, by allowing infinite-range energy quantization coefficients to be encoded in not only the FPC method but also the Huffman encoding method, the number of bits used to encode the infinite-range energy quantization coefficients may be reduced, and accordingly, a more number of bits may be allocated to spectral encoding.

Figure 6:
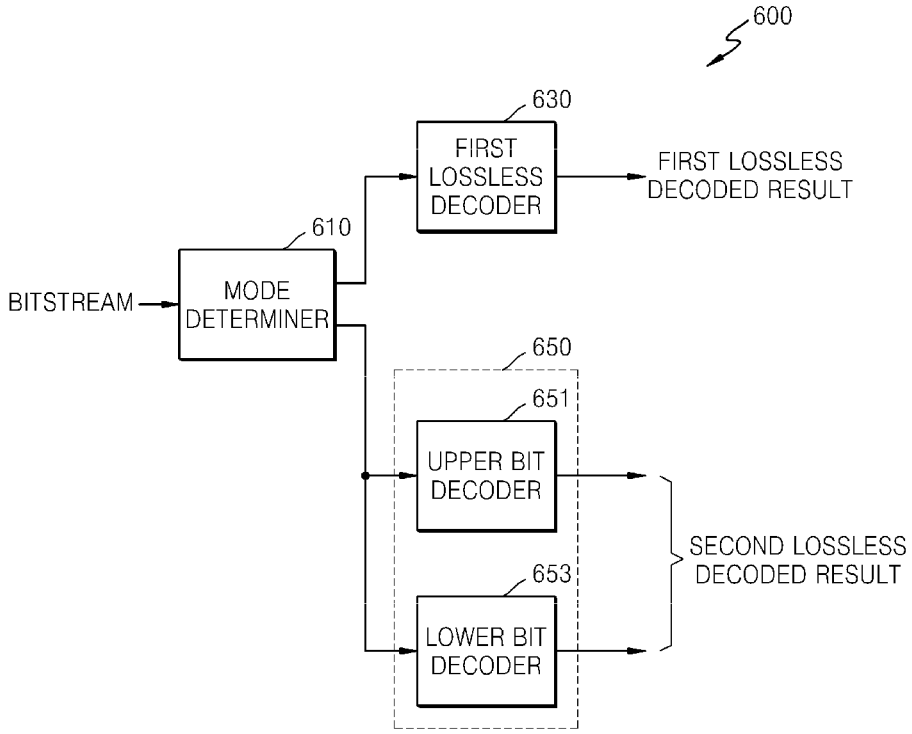
FIG. 6 is a block diagram of an energy lossless decoding apparatus according to an exemplary embodiment.

FIG. 6 is a block diagram of an energy lossless decoding apparatus according to an exemplary embodiment.

The energy lossless decoding apparatus 600 shown in FIG. 6 may include a mode determiner 610, a first lossless decoder 630, and a second lossless decoder 650. The second lossless decoder 650 may include an upper bit decoder 651 and a lower bit decoder 653. The components may be integrated in at least one module and be implemented by at least one processor (not shown).

Referring to FIG. 6, the mode determiner 610 may parse a bitstream and determine a lossless encoding mode of energy data and upper bit data from first additional information D0 and second additional information D1. First, the first additional information D0 is checked, and the mode determiner 610 may provide the energy data to the first lossless decoder 610 in a case of the first lossless encoding mode and provide the energy data to the second lossless decoder 630 in a case of the second lossless encoding mode.

The first lossless decoder 630 may lossless-decode the energy data provided from the mode determiner 610 by using FPC.

In the second lossless decoder 650, the upper bit decoder 651 may lossless-decode upper bit data of the energy data provided from the mode determiner 610 by checking the second additional information D1. The lower bit decoder 653 may lossless-decode lower bit data of the energy data provided from the mode determiner 610

Figure 7:
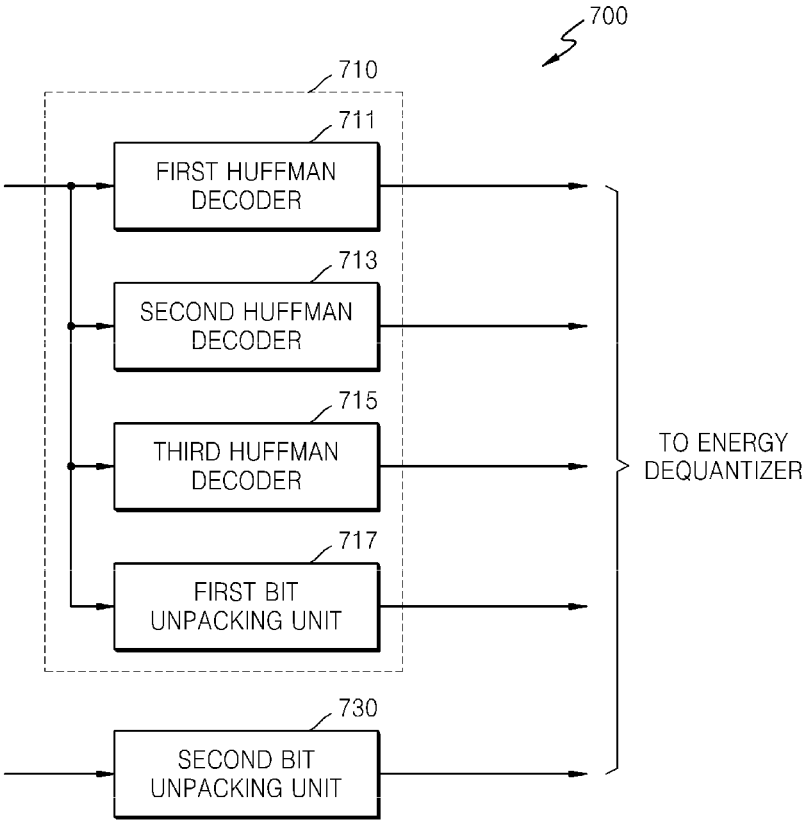
FIG. 7 is a block diagram of a second lossless decoder of the energy lossless decoding apparatus of FIG. 6, according to an exemplary embodiment.

FIG. 7 is a detailed block diagram of the second lossless decoder 650 of FIG. 6, according to an exemplary embodiment.

The second lossless decoder 700 shown in FIG. 7 may include an upper bit decoder 710 and a second bit unpacking unit 730. The upper bit decoder 710 may include a plurality of Huffman decoders, e.g., first to third Huffman decoders 711, 713, and 715, and a first bit unpacking unit 717. The first to third Huffman decoders 711, 713, and 715 and the first bit unpacking unit 717 may be respectively implemented in the same manner as the first to third Huffman encoders 411, 413, and 415 and the first bit packing unit 417.

Referring to FIG. 7, the first to third Huffman decoders 711, 713, and 715 and the first bit unpacking unit 717 of the upper bit decoder 710 may lossless-decode the upper bit data of the energy data provided from the mode determiner 610 according to the second additional information D1. For example, the lossless decoding using a Huffman table may be performed by providing the upper bit data to the first Huffman decoder 711 when D1=00, providing the upper bit data to the second Huffman decoder 713 when D1=01, and providing the upper bit data to the third Huffman decoder 711 when D1=10. When D1=11, bit unpacking of the upper bit data may be performed by providing the upper bit data to the first bit unpacking unit 717.

The second bit unpacking unit 719 may receive lower bit data of the energy data and perform bit unpacking of the lower bit data.

Figure 8:
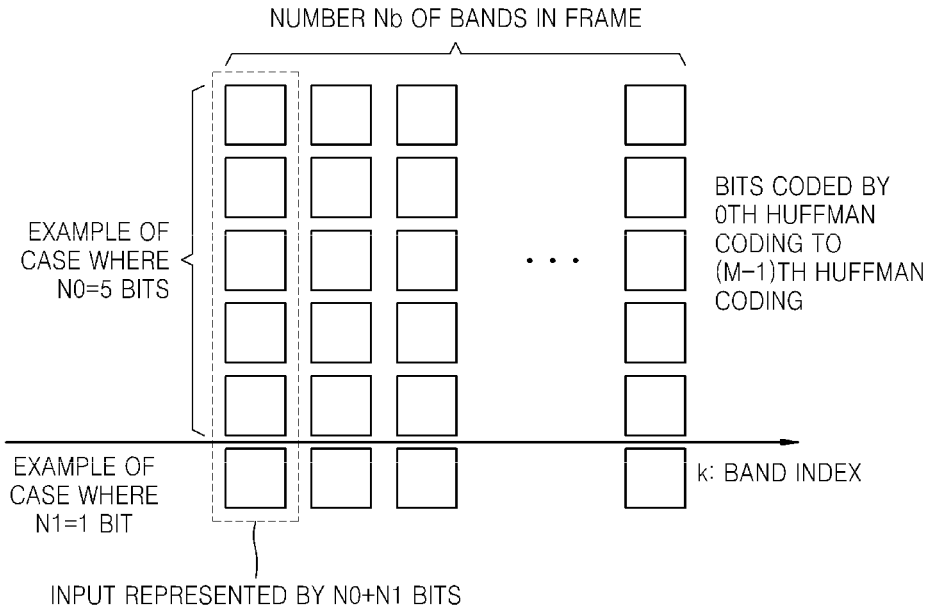
FIG. 8 is a diagram for describing an energy quantization coefficient of a finite range.

FIG. 8 is a diagram for describing an energy quantization coefficient which can be represented as a finite range, i.e., a specific number of bits, wherein N is 6, N0 is 5, and N1 is 1 as an example. Referring to FIG. 8, the 5 upper bits may be encoded in a Huffman encoding method, and the 1 lower bit may be encoded in a bit packing method.

Figure 9:
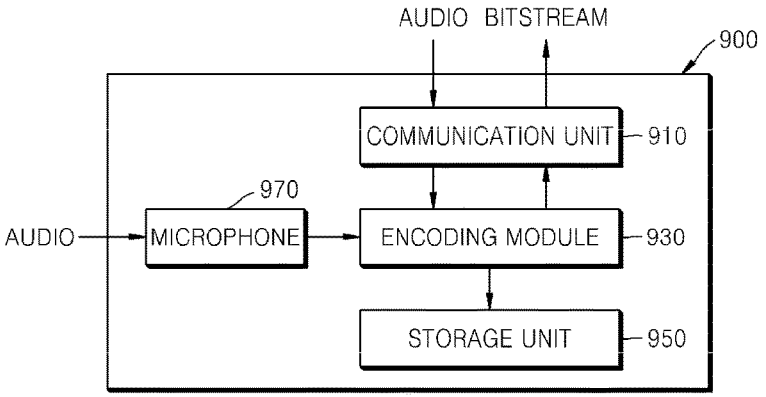
FIG. 9 is a block diagram of a multimedia device according to an exemplary embodiment.

FIG. 9 is a block diagram of a multimedia device including an encoding module 930, according to an exemplary embodiment.

The multimedia device 900 shown in FIG. 9 may include a communication unit 910 and the encoding module 930. In addition, the multimedia device 900 may further include a storage unit 950 for storing an audio bitstream, which is obtained as an encoded result, according to the usage of the audio bitstream. In addition, the multimedia device 900 may further include a microphone 970. That is, the storage unit 950 and the microphone 970 are optional. In addition, the multimedia device 900 may further include an arbitrary decoding module (not shown), e.g., a decoding module for performing a general decoding function or a decoding module according to an exemplary embodiment. The encoding module 930 may be combined with other components (not shown) included in the multimedia device 900 in a one body and implemented as at least one processor (not shown).

Referring to FIG. 9, the communication unit 910 may receive at least one of audio and an encoded bitstream provided from the outside or transmit at least one of reconstructed audio and an audio bitstream obtained as an encoded result.

The communication unit 910 may be configured to transmit and receive data to and from an external multimedia device via a wireless network, such as wireless Internet, wireless Intranet, a wireless telephone network, a wireless local area network (WLAN), Wi-Fi, Wi-Fi Direct (WFD), third generation (3G), fourth generation (4G), Bluetooth, infrared data association (IrDA), radio frequency identification (RFID), ultra wideband (UWB), Zigbee, or near field communication (NFC), or a wired network, such as a wired telephone network or wired Internet.

According to an exemplary embodiment, the encoding module 930 may transform an audio signal in the time domain, which is provided through the communication unit 910 or the microphone 970, into an audio spectrum in the frequency domain, determine a lossless encoding mode of an energy quantization coefficient obtained from the audio spectrum in the frequency domain as one of an infinite-range lossless encoding mode and a finite-range lossless encoding mode, and encode the energy quantization coefficient in the infinite-range lossless encoding mode or the finite-range lossless encoding mode according to a result of the lossless encoding mode determination. In addition, when delta coding is applied to the lossless encoding mode determination, according to whether difference values between energy quantization coefficients of all frequency bands in a current frame are represented as a predetermined number of bits, one of the infinite-range lossless encoding mode and the finite-range lossless encoding mode may be determined. Even though the difference values between the energy quantization coefficients of all the frequency bands in the current frame are represented as a predetermined number of bits, according to results of encoding an energy quantization coefficient in the infinite-range lossless encoding mode and the finite-range lossless encoding mode, one of the infinite-range lossless encoding mode and the finite-range lossless encoding mode may be determined. Additional information indicating a lossless encoding mode determined for the energy quantization coefficients may be generated. The infinite-range lossless encoding mode may be performed by FPC, and the finite-range lossless encoding mode may be performed by the Huffman encoding. In addition, in the finite-range lossless encoding mode, an energy quantization coefficient may be divided into upper bits and lower bits and encoded. The upper bits may be encoded using a plurality of Huffman tables or by bit packing, and additional information indicating an encoding mode of the upper bits may be generated. The lower bits may be encoded by bit packing.

The storage unit 950 may store the encoded bitstream generated by the encoding module 930. In addition, the storage unit 950 may store various programs required to operate the multimedia device 900.

The microphone 970 may provide an audio signal of a user or the outside to the encoding module 930.

Figure 10:
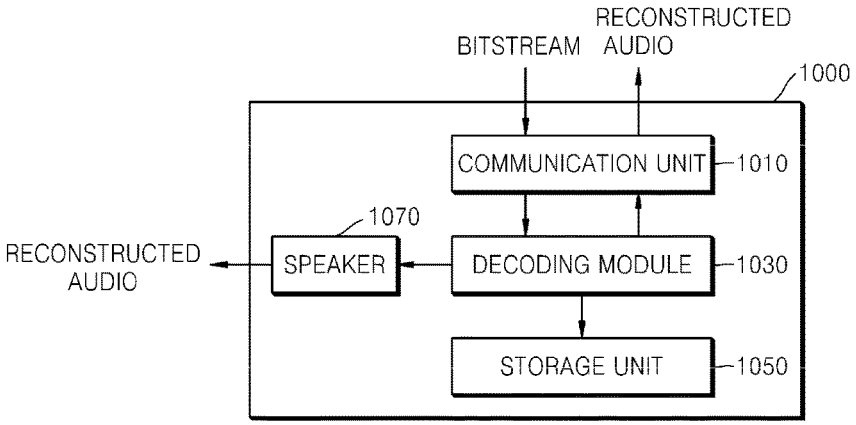
FIG. 10 is a block diagram of a multimedia device according to another exemplary embodiment.

FIG. 10 is a block diagram of a multimedia device including a decoding module, according to another exemplary embodiment.

The multimedia device 1000 shown in FIG. 10 may include a communication unit 1010 and the decoding module 1030. In addition, the multimedia device 1000 may further include a storage unit 1050 for storing a reconstructed audio signal, which is obtained as a decoding result, according to the usage of the reconstructed audio signal. In addition, the multimedia device 1000 may further include a speaker 1070. That is, the storage unit 1050 and the speaker 1070 are optional. In addition, the multimedia device 1000 may further include an arbitrary encoding module (not shown), e.g., an encoding module for performing a general encoding function or an encoding module according to an exemplary embodiment. The decoding module 1030 may be combined with other components (not shown) included in the multimedia device 1000 in a one body and implemented as at least one processor (not shown).

Referring to FIG. 10, the communication unit 1010 may receive at least one of an encoded bitstream and an audio signal provided from the outside or may transmit at least one of reconstructed audio and an audio bitstream obtained as a decoded result. The communication unit 1010 may be implemented to be substantially similar to the communication unit 910 of FIG. 9.

According to an embodiment of the present invention, the decoding module 1030 may receive a bitstream through the communication unit 1010, determine a lossless encoding mode of an energy quantization coefficient included in the bitstream, and decode the energy quantization coefficient in an infinite-range lossless decoding mode or a finite-range lossless decoding mode in correspondence with a result of the lossless encoding mode determination. The infinite-range lossless decoding mode may be performed by FPC, and the finite-range lossless decoding mode may be performed the Huffman decoding. In addition, in the finite-range lossless decoding mode, an energy quantization coefficient may be divided into upper bits and lower bits and decoded, wherein the upper bits may be decoded using a plurality of Huffman tables or by bit unpacking, and the lower bits may be decoded by bit unpacking.

The storage unit 1050 may store a restored audio signal generated by the decoding module 1030. In addition, the storage unit 1050 may store various programs required to operate the multimedia device 1000.

The speaker 1070 may output the reconstructed audio signal generated by the decoding module 1030 to the outside.

Figure 11:
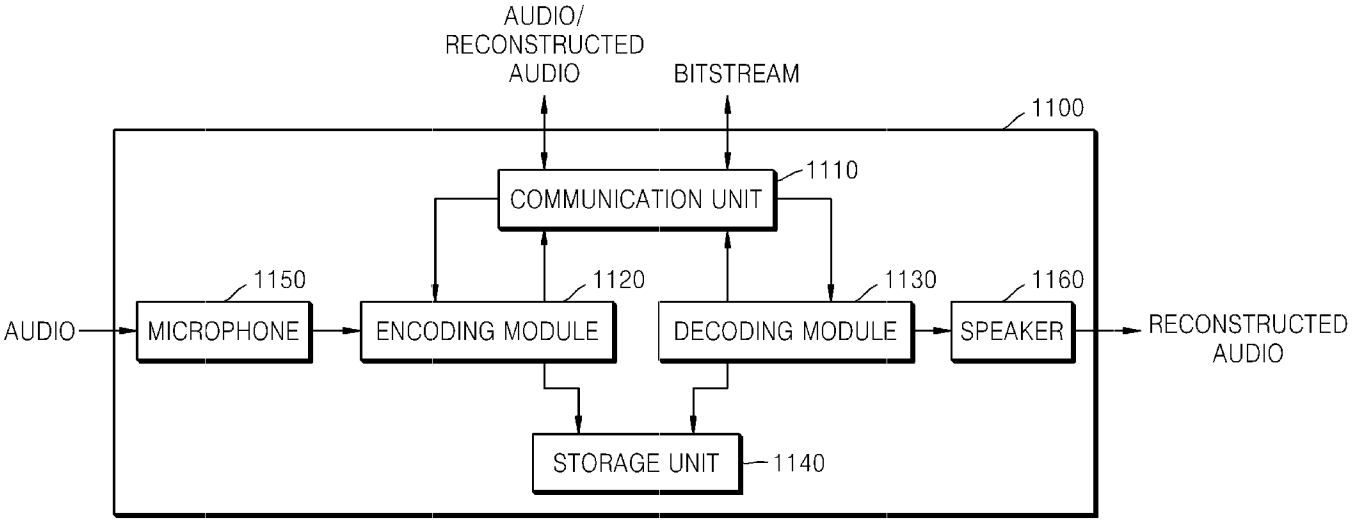
FIG. 11 is a block diagram of a multimedia device according to another exemplary embodiment.

FIG. 11 is a block diagram of a multimedia device including an encoding module and a decoding module, according to another exemplary embodiment.

The multimedia device 1100 shown in FIG. 11 may include a communication unit 1110, the encoding module 1120, and the decoding module 1130. In addition, the multimedia device 1100 may further include a storage unit 1040 for storing an audio bitstream or a restored audio signal, which is obtained as an encoded result or a decoded result, according to the usage of the audio bitstream or the reconstructed audio signal. In addition, the multimedia device 1100 may further include a microphone 1150 or a speaker 1160. The encoding module 1120 or the decoding module 1130 may be combined with other components (not shown) included in the multimedia device 1100 in a one body and implemented as at least one processor (not shown).

Since the components shown in FIG. 11 are the same as the components of the multimedia device 900 shown in FIG. 9 or the components of the multimedia device 1000 shown in FIG. 10, a detailed description thereof is omitted.

Each of the multimedia devices 900, 1000, and 1100 may further include a voice communication dedicated terminal including a telephone, a mobile phone, and so forth, a broadcast or music dedicated device including a TV, an MP3 player, and so forth, or a complex terminal device of the voice communication dedicated terminal and the broadcast or music dedicated device but is not limited thereto. In addition, each of the multimedia devices 900, 1000, and 1100 may be used as a client, a server, or a conversion device disposed between a client and a server.

When the multimedia device 900, 1000, or 1100 is, for example, a mobile phone, although not shown, the mobile phone may further include a user input unit, such as a keypad, a user interface or a display unit for displaying information processed by the mobile phone, and a processor for controlling a general function of the mobile phone. In addition, the mobile phone may further include a camera unit having an image capturing function and at least one component for performing a function required by the mobile phone.

When the multimedia device 900, 1000, or 1100 is, for example, a TV, although not shown, the TV may further include a user input unit, such as a keypad, a display unit for displaying received broadcast information, and a processor for controlling a general function of the TV. In addition, the TV may further include at least one component for performing a function required for the TV.

The methods according to the embodiments can be written as computer programs and can be implemented in general-use digital computers that execute the programs using a computer-readable recording medium. In addition, data structures, program instructions, or data files, which can be used in the embodiments of the present invention, can be recorded in the computer-readable recording medium in various manners. The computer-readable recording medium is any data storage device that can store data which can be thereafter read by a computer system. Examples of the computer-readable recording medium include magnetic recording media, such as hard disks, floppy disks, and magnetic tapes, optical recording media, such as CD-ROMs and DVDs, magneto-optical media, such as floptical disks, and hardware devices, such as read-only memory (ROM), random-access memory (RAM), and flash memory, specially configured to store and execute program instructions. In addition, the computer-readable recording medium may be a transmission medium for transmitting a signal indicating a program instruction, a data structure, or the like. Examples of the program instruction may include machine language code generated by a compiler and high-level language code which can be executed by a computer using an interpreter.

While the present inventive concept has been particularly shown and described with reference to exemplary embodiments thereof, it will be understood by those of ordinary skill in the art that various changes in form and details may be made therein without departing from the spirit and scope of the present inventive concept as defined by the following claims.

What is claimed is:

1. An apparatus for coding an envelope of a signal including at least one of audio and speech, the apparatus comprising:

at least one processor configured to:

select one of a first coding method and a second coding method for a differential quantization index of the envelope, based on at least one of a bit consumption and a range in which the differential quantization index is represented;

encode the differential quantization index using the selected coding method;

generate a bitstream including at least the encoded differential quantization index; and transmit the bitstream for reproduction in a decoding side, and wherein the at least one processor is configured to:

determine whether the differential quantization index in all bands of a frame is represented by the range;

select the first coding method when at least one differential quantization index in all the bands of the frame is not represented by the range;

compare a bit consumption of the first coding method with a bit consumption of the second coding method, when the differential quantization index in all the bands of the frame is represented by the range;

select the first coding method when the differential quantization index in all the bands of the frame is represented by the range and the bit consumption of the first coding method is less than the bit consumption of the second coding method; and select the second coding method when the differential quantization index in all the bands of the frame is represented by the range and the bit consumption of the second coding method is less than the bit consumption of the first coding method, and wherein the second coding method includes a context based Huffman coding mode and a resized Huffman coding mode, wherein in the context based Huffman coding mode, the at least one processor is configured to obtain a context of a current band by using a differential quantization index of a previous band, and Huffman encode the differential quantization index of the current band based on the context of the current band, wherein in the resized Huffman coding mode, the at least one processor does not obtain the context of the current band, and is configured to Huffman encode the differential quantization index of the current band without the context of the current band, and wherein in the second coding method, the at least one processor is configured to split bits representing the differential quantization index into first group bits and second group bit and to Huffman encode the first group bits and process the second group bit by bit packing without Huffman encoding, respectively.

2. The apparatus of claim 1, wherein a coding method is determined on a frame by frame basis.

3. The apparatus of claim 1, wherein the differential quantization index is associated with energy of an audio signal.

4. An apparatus for decoding an envelope of a signal including at least one of audio and speech, the apparatus comprising:

at least one processor configured to:

receive a bitstream including at least an encoded differential quantization index from an encoding side;

determine one of a first decoding method and a second decoding method, based on information included in the bitstream, where the first and the second decoding methods are associated with a bit consumption and a range in which a differential quantization index of the envelope is represented; and decode the encoded differential quantization index by using the determined decoding method, wherein the second decoding method includes a context based Huffman decoding mode and a resized Huffman decoding mode, wherein in the context based Huffman decoding mode, the at least one processor is configured to obtain a context of a current sub-band by using a decoded differential quantization index of a previous sub-band, and Huffman decode the encoded differential quantization index of the current sub-band based on the context of the current sub-band, wherein in the resized Huffman decoding mode, the at least one processor does not obtain the context of the current sub-band, and is configured to Huffman decode the encoded differential quantization index of the current sub-band without the context of the current sub-band, and wherein in the second decoding method, the at least one processor is configured to decode first group bits representing the differential quantization index by Huffman decoding and unpack second group bit representing the differential quantization index without the Huffman decoding, respectively.

5. The apparatus of claim 4, wherein the at least one processor is configured to split bits representing the differential quantization index into upper bits and at least one lower bit and to Huffman decode the upper bits and process the at least one lower bit by bit packing, respectively.

6. The apparatus of claim 1, wherein the range in which the differential quantization index is represented is wider in the first coding method than in the second coding method.

7. The apparatus of claim 4, wherein the range in which the differential quantization index is represented is wider in the first decoding method than in the second decoding method.

* * * * *